United States Patent [19]

Williams

[11] 4,305,236

[45] Dec. 15, 1981

[54] RAIN GUTTER SYSTEM

[76] Inventor: Robert F. Williams, 10069 E. Atherton Rd., Davison, Mich. 48423

[21] Appl. No.: 111,722

[22] Filed: Jan. 14, 1980

[51] Int. Cl.[3] ..... E04D 13/00

[52] U.S. Cl. ..... 52/11; 248/48.1

[58] Field of Search ..... 52/11; 248/48.1, 48.2

[56] References Cited

U.S. PATENT DOCUMENTS

| | | | |
|---|---|---|---|
| 270,037 | 1/1883 | Erwin | 248/48.1 |
| 370,073 | 9/1887 | Lumm | 248/48.1 |
| 588,151 | 8/1897 | Isham | 248/48.1 |
| 1,160,124 | 11/1915 | Andreas | 248/48.1 |
| 1,630,746 | 5/1927 | Inman | 248/48.1 |
| 2,004,448 | 6/1935 | Sansonetti | 248/48.1 |
| 2,631,801 | 3/1953 | Toal | 248/48.1 |
| 2,843,063 | 7/1958 | Thomson | 108/28 |
| 3,333,803 | 8/1967 | Landis | 248/48.2 |
| 3,357,143 | 12/1967 | Bayes | 52/11 |
| 3,864,882 | 2/1975 | Lasscock | 52/11 |
| 4,128,974 | 12/1978 | Taylor | 52/11 |

FOREIGN PATENT DOCUMENTS

| | | | |
|---|---|---|---|
| 1244837 | 9/1971 | United Kingdom | 52/11 |

*Primary Examiner*—Price C. Faw, Jr.
*Assistant Examiner*—Henry E. Raduazo
*Attorney, Agent, or Firm*—Gifford, VanOphem, Sheridan & Sprinkle

[57] ABSTRACT

A rain gutter system including plastic rain gutters mounted in place either by a hanger fastened directly to a vertically extending fascia board or by a metal strap which snaps onto the hanger and is mounted to the roof when there is no fascia board or when the fascia board is not vertical.

11 Claims, 4 Drawing Figures

RAIN GUTTER SYSTEM

BACKGROUND OF THE INVENTION

I. Field of the Invention

The present invention relates generally to rain gutter systems and, more particularly, to a plastic rain gutter system having novel means for securing the rain gutter to a building.

II. Description of the Prior Art

Most buildings include rain gutters positioned underneath the edges of the roof of the building in order to collect and channel water passing down from the roof to downspouts connected to the gutters. Most of these rain gutters, in the past, have been metal and have been rigidly and permanently secured to a fascia board on the building by hammering nails through the rain gutter and into the fascia board.

These previously known rain gutters, however, have been disadvantageous in a number of different respects. First, they have been usually constructed of galvanized metal, and thus are both expensive to manufacture and, due to their weight, difficult to install. Moreover, these metal gutters require periodic painting in order to maintain an attractive appearance. The painting of the gutters and of the fascia board behind a gutter is a difficult and tedious task.

A still further disadvantage of these previously known rain gutters is that they are permanently secured to the house and thus are not easily removable. Removal is desirable not only to facilitate the painting of the fascia board behind the rain gutter but is also very advantageous in those climates where heavy snows occur during winter. Snow and ice accumulations in the rain gutter can damage the rain gutter but can also cause ice backup underneath the shingles on the roof of the building. Such ice backup can damage both the roof and the shingles. Removal of the rain gutter during winter eliminates this problem.

A still further disadvantage of the previously known rain gutters is that the gutter can be easily attached only to buildings having a generally vertical fascia board into which the fastening nails can be driven. Many types of buildings, however, have a non-vertical fascia board and, in some cases, no fascia board whatsoever. Thus, for such buildings, it is necessary to specially fabricate supports to which the gutter can be attached.

SUMMARY OF THE PRESENT INVENTION

The present invention overcomes the above mentioned disadvantages of the previously known rain gutters by providing a plastic rain gutter system which can be simply and rapidly installed on virtually all types of buildings and which is inexpensive and maintenance free. Moreover, the rain gutter system of the present invention can be easily detached from the building when and if that is desired.

In brief, a preferred embodiment of the rain gutter system of the present invention comprises at least one elongated rain gutter which is then walled and substantially U-shaped in cross section. Hanger brackets having a U-shaped channel which conforms to the outer periphery of the gutter, are positioned around the gutter at the junction of sections of the gutter and at spaced intervals along its length. Both the hanger brackets and the gutter are constructed of plastic for its lightweight, inexpensive and maintenance free properties.

The hanger brackets can be secured directly to the fascia board by screws or the like to hold the gutter in place if the fascia board is vertical or a strap-type hanger is provided to fasten the hanger and thus the gutter in place for those buildings which have a non-vertical fascia board or no fascia board whatsoever. The strap-type hanger is made of a malleable material, such as thin metal, which can be bent so that the gutter will be mounted in the proper position regardless of the angle of the roof of the building.

The strap-type hanger is provided with an aperture to mate with a lateral protrusion on the hanger bracket to permit the members to be snapped together.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
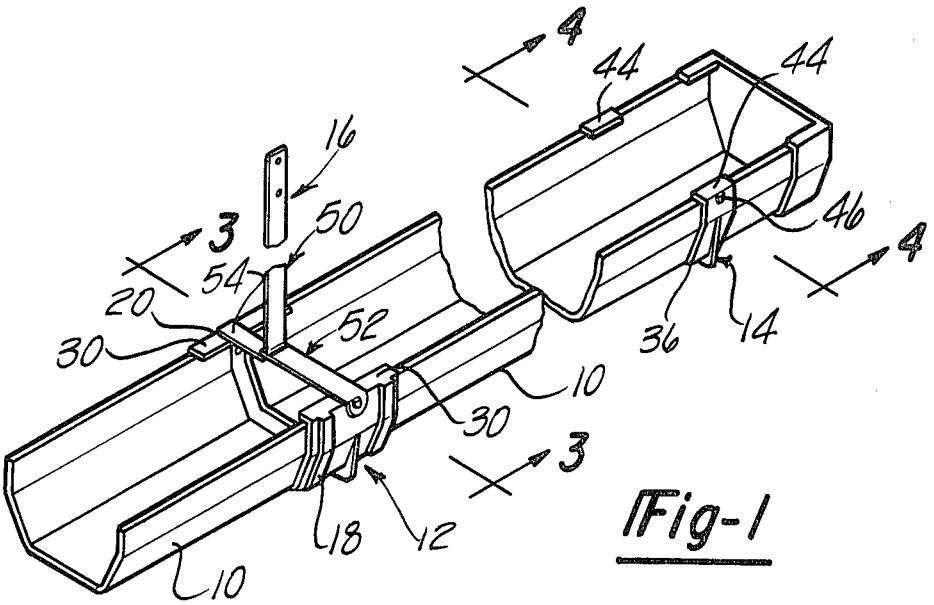
FIG. 1 is a fragmentary perspective view illustrating a preferred embodiment of the rain gutter system of the present invention.
Figure 2:
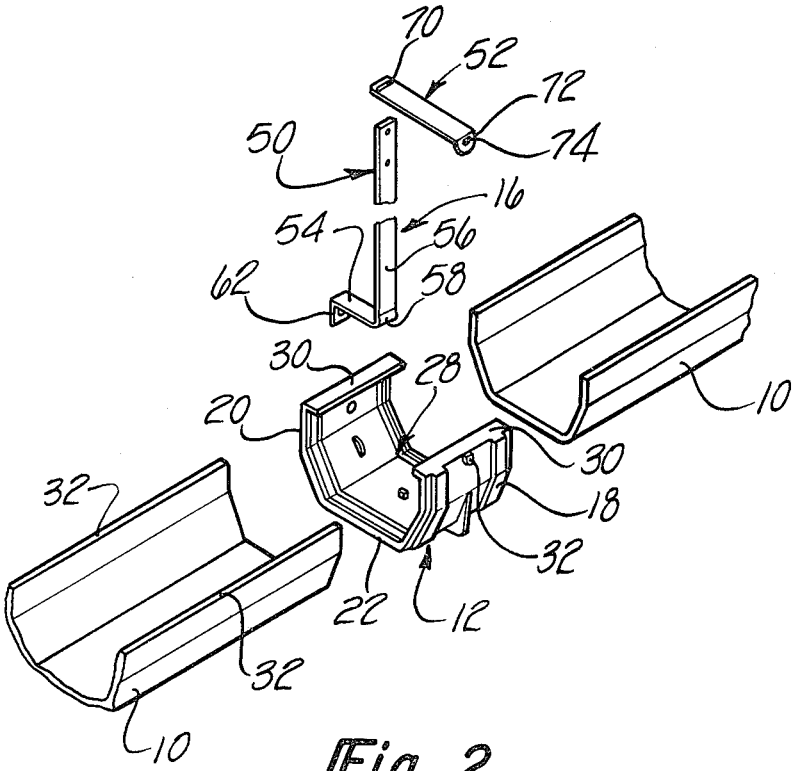
FIG. 2 is a view similar to FIG. 1 illustrating the preferred embodiment in an exploded perspective view.

Referring to FIGS. 1 and 2, a preferred embodiment of the present invention is illustrated as comprising rain gutters 10 joined together by a gutter slip joint 12 and supported at spaced intervals by gutter brackets 14, only one of which is shown. As will be described in greater detail below, in some installations the rain gutters 10 will be mounted to a building by screws or the like which mount the slip joints 12 and the brackets 14 to the building and in other installations gutter strap hangers like those illustrated at 16 will be used to mount the joints 12 and the brackets 14, and thus the gutters 10, to the building.

Figure 3:
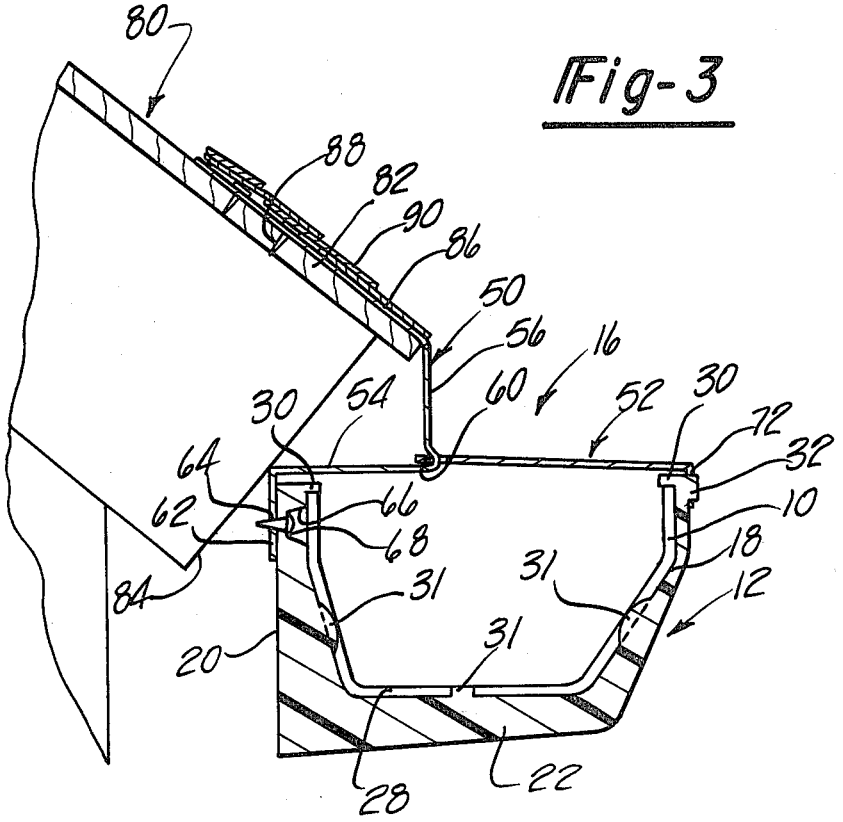
FIG. 3 is a sectional view showing one method of attachment of the rain gutter system of the present invention to a building.

Referring to FIGS. 1, 2 and 3, the slip joint 12 as indicated above is intended to support the ends of two lengths of rain gutter 10 and is generally U-shaped in cross section to fit over the ends of the adjacent lengths of rain gutter 10. The slip joint 12 is thus provided with spaced, upwardly extending sections 18 and 20 joined by a lower portion 22 extending therebetween. The slip joint 12 thus defines an interior, U-shaped channel 28 having the same shape and a slightly larger size than the outer periphery of the rain gutter 10 so that the ends of the adjacent rain gutters can be received within the channel 28. A lip 30 extends inwardly into the channel 28 from adjacent the upper free end of each portion 18 and 20 to aid in retaining the ends of the gutters 10 within the channel 28 of the slip joint 12.

As can best be seen in FIG. 1, it is preferred to leave a sufficient space between the ends of the adjacent rain gutters 10 to permit expansion and contraction of the gutters caused by changes in the temperature. Inwardly formed stops 31 (FIG. 3) limit inward movement of the gutters 10 to ensure the necessary space between them.

As can best be seen in FIG. 2, an outwardly extending protrusion 32 is provided adjacent the upper end of the upwardly extending section 18. The function of the protrusion 32 will become more apparent as the description proceeds.

Figure 4:
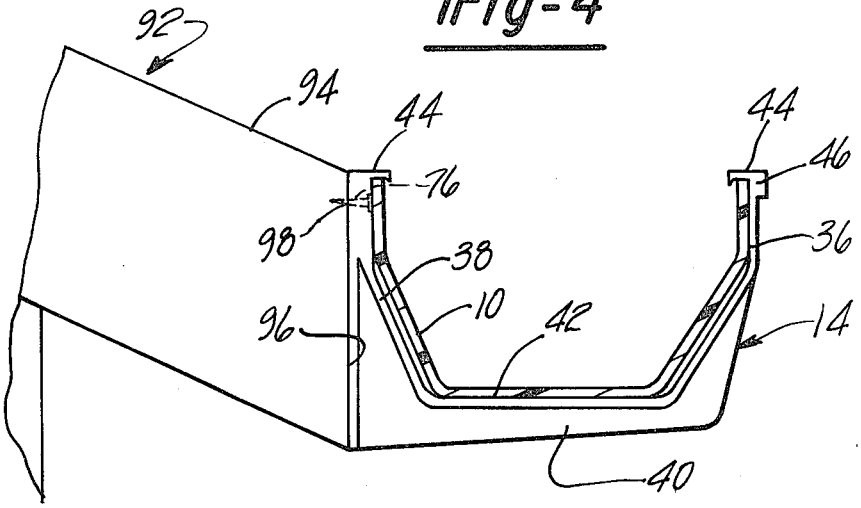
FIG. 4 is a sectional view similar to FIG. 3 but showing the attachment of the rain gutter system of the present invention to a building having a vertical fascia board.

The hanger bracket 14 is similar in construction to the slip joint 12 and as can best be seen in FIG. 1 and 4, includes spaced, upwardly extending sections 36 and 38 joined by a lower portion 40 to provide a U-shaped channel 42 for receiving the rain gutter 10. Lips 44 are provided at the upper edges of the sections 36 and 38 to aid in retaining the gutter 10 within the channel 42. A protrusion 46 is provided on the upper outer surface of the portion 40.

The gutter strap hanger 16, as can best be seen in FIGS. 1, 2 and 3, preferably comprises a first strap 50 and a second strap 52. Both straps 50 and 52 are made of metal and are sufficiently thin and malleable so that they can be manually bent.

The first strap 50 includes a short leg 54 and a longer leg 56 which extends perpendicularly outwardly from the short leg 54 thus forming a corner 58 (FIG. 2). The first strap 50 protrudes slightly outwardly at the corner 58 to form a small recess 60 (FIG. 3).

The free end of the short leg 54 is also perpendicularly bent with respect to the short leg 54 thus forming a short tab 62 which is adapted to flatly abut against the outer periphery of the portion 20 of the slip joint 12 as best seen in FIG. 3. An aperture 64 through the tab 64 is adapted to register with an aperture 66 in the portion 20 of the slip joint 12 to secure the first strap 50 to the slip joint 12 by a self-tapping screw 68 extending through the apertures 64 and 66. Moreover, with the first strap 50 secured to the slip joint 12 in the above described fashion, the short leg 54 of the first strap 50 extends horizontally across the top of the slip joint 12 and towards but terminates short of the portion 18 of the slip joint 12.

Still referring to FIGS. 1–3, the second strap 52 has a lateral slot 70 (FIG. 2) formed through one end and a right angled tab 72 formed at its other end. The first strap 50 is positioned through the slot 70 so that the end of the second strap 52 opposite the tab 72 is positioned within the recess 60 in the first strap 50. The tab 72 on the second strap 52 also includes an aperture 74 through which the protrusion 32 formed on the portion 18 of the slip joint 12 extends in order to secure the second strap 52 to the slip joint 12. The second strap 52, like the short leg 54 of the first strap 50, extends generally horizontally over the channel 28 of the slip joint 12 and towards the upwardly extending portion 31. Moreover, the total length of the short leg 54 of the first strap 50 and of the second strap 52, exclusive of their respective tabs 62 and 72, is substantially the same as the width of the slip joint 12.

While it has been preferred to describe the strap hanger assembly 16 as being fastened to the slip joint 12 by means of the protrusion 32 and the screw 64, it should be understood that the gutter brackets 14 are intended in some installations to also be similarly attached to the gutter strap hanger 16 and when they are, the aperture 74 of the second strap 52 would receive the protrusion 46 formed on the portion 36 of the bracket 14 and a screw 76 (FIG. 4) would extend through an aperture 78 provided in the portion 38 of the bracket 14 and into the aperture 64 of the tab 62 of the first strap 54 of the hanger 16.

Referring now particularly to FIG. 3, one method of attaching the hanger assembly 36 to a building 80 is thereshown in which the building 80 includes a roof 82 and a non-vertical fascia board 84. In this case, the first strap 50 is bent so that a portion 86 of the strap 50 flatly abuts against the top of the roof 82 and is secured in place by the nails 88 or other appropriate fasteners. This portion 86 of the first strap 50 can be positioned underneath and covered by shingles 90, as shown in FIG. 3, in the case of a new building construction or, alternatively, the strap portion 86 can be secured directly over the shingles 90. The outer edge of the roof 82 preferably protrudes outwardly over the rain gutter 10 due to the connection between the straps 50 and 52 so that rain water passing over the edge of the roof 86 enters the gutter 10.

It should be understood that although FIG. 3 illustrates the use of the gutter strap hanger 16 only with a slip joint 12, a gutter strap hanger 16 would be used to mount each slip joint 12 to the building and also would be used to mount each gutter bracket 14 to the building 70 where such a building includes a non-vertical fascia 84 like the building construction illustrated in FIG. 3. A slip joint like the slip joint 12 would be used whereever two gutters 10 meet and it is preferred that gutter brackets 14 be used at 30 inch intervals to provide proper support.

The assembly illustrated in FIG. 3 would also be used in those building constructions in which no fascia board whatsoever is provided.

Referring now to FIG. 4, a method of attaching the rain gutter 10 to a building 92 is thereshown in which the building 92 includes a roof 94 and a generally vertically extending fascia board 96. In this case, the gutter strap hanger 16 is not used and, instead, the slip joints 12 and the hanger brackets 14 are directly secured to the fascia board 96 by a nail or screw 98 extending through the apertures 66 and 76 in the portions 20 and 38 of the slip joint 12 and the hanger bracket 14 respectively.

Again it is to be understood that with a building construction with a vertical fascia like that illustrated in FIG. 4, both slip joints 12 and the hanger brackets 14 would be fastened to the fascia board 96 in this manner.

It is apparent that with the construction of the present invention the rain gutters 10 can be readily removed for cleaning or, in areas where ice and snow present problems, for the wintertime.

When the building has no fascia board or a non-vertical fascia board so that gutter strap hangers 16 are employed, the rain gutter 10 can be removed by squeezing the sides of the brackets for the rain gutte 10 together to permit the protrusions 32 and 46 on the brackets to be released from the aperture 74. The strap 52 is pivoted upwardly and the rain gutter 10 is removed through opening. The gutter strap hangers 16, the slip joints 12 and the brackets 14 are left in place to receive the rain gutters 10 when it is desired to again mount the rain gutters to the building.

Similarly, when a vertical fascia is provided so that the slip joints 12 and the brackets 14 are mounted in the manner shown in FIG. 4, the rain gutters 10 can be removed by squeezing the sides together to permit them to be removed past the lips 30 and 44. Again the slip joint 12 and the brackets 14 are left in place while the rain gutters 10 are stored.

It can, therefore, be seen that the rain gutter system according to the present invention is advantageous in several different respects. First, it can be easily installed on buildings having either vertical or non-vertical fascia boards or even no fascia board at all. Moreover, the rain gutters 10 can be simply, easily and rapidly removed from the slip joints 12 and the hanger brackets 14 as desired. The removal and/or installation of the rain gutter 10 is relatively simple to accomplish due to the light wiehgt construction of the plastic rain gutters 10. In addition, once installed, the plastic rain gutter system of the present invention is entirely maintenance-free and never requires painting.

Having described my invention, however, many modifications thereto will become apparent to those skilled in the art to which it pertains without deviation from the spirit of the invention as defined by the scope of the appended claims.

I claim:

1. A rain gutter system for a building comprising:

at least one elongated rain gutter, said gutter being substantially U-shaped in cross section;

a support member having a U-shaped channel in which at least a portion of said gutter is positioned:

means for securing said support member to the building;

wherein said securing means further comprises a hanger asembly and means for securing said hanger assembly to said support member on both sides of said channel and means for securing said hanger assembly to said building;

wherein said hanger assembly further comprises a first strap having one end secured to said support member on one side of said channel and its other end secured to the building, and a second strap having one end secured to said support member on the other side of said channel and its other end secured near the midpoint of the first strap;

further comprising means for manually releasably securing one end of one of said straps to said support member so that, upon release, said gutter can be removed from said support member; and wherein said support member is constructed of a flexible resilient material and wherein said releasable securing means further comprises a protrusion extending outwardly from said support member and said one end of said last mentioned strap including an aperture through which said protrusion extends and is resiliently retained.

2. The invention as defined in claim 1 wherein the other end of the secon strap includes a slot through which the first strap is positoned to thereby secure the straps together.

3. The invvention as defined in claim 1 wherein said protrusion extends laterally outwardly from said support member and from said channel.

4. The invention as defined in claim 1 wherein said first strap is constructed of a malleable material whereby said first strap can be manually bent so that a portion of said first strap flatly abuts against the building.

5. The invention as defined in claim 4 wherein said first strap is made of metal.

6. The invention as defined in claim 4 wherein said building includes a roof covered with shingles and wherein said first strap is bent so that said portion of the first strap flatly abuts and is secured against said roof.

7. The invention as defined in claim 1 wherein said support member and said gutter are both constructed of plastic.

8. The invention as defined in claim 1 wherein said support member is axially dimensioned to support two axially aligned and adjacent rain gutters.

9. The invention as defined in claim 2 wherein a portion of said first strap and said second strap extend substantially horizontally over the support member channel.

10. The invention as defined in claim 2 wherein said first strap includes a second portion which extends substantially perpendicularly outwardly from said first portion and from said channel thus forming a corner with said first portion of said strap, said corner protruding outwardly from said first strap and forming a recess, said other end of said second strap being positioned in said recess.

11. The invention as defined in claim 1 wherein said building inlcudes a generally vertical fascia board, said support member having a leg which abuts against the fascia board, and wherein said securing means comprises a fastener having one end extending through an aperature in said leg of said support member and into said fascia board, the other end of said fastener abutting against said leg of said support member.

* * * * *

UNITED STATES PATENT AND TRADEMARK OFFICE

CERTIFICATE OF CORRECTION

PATENT NO. : 4,305,236

DATED : December 15, 1981

INVENTOR(S) : Robert F. Williams

It is certified that error appears in the above-identified patent and that said Letters Patent are hereby corrected as shown below:

Column 3, line 29, second occurrence, delete "64" and insert --62-- therefor.

Column 3, line 51, delete "31" and insert --20-- therefor.

Column 4, line 22, delete "70" and insert --80-- therefor.

Column 4, line 24, delete "whereever" and insert --wherever-- therefor.

Column 4, line 38, delete "76" and insert --78-- therefor.

Column 4, line 51, delete "gutte" and insert --gutter-- therefor.

Column 6, line 4, delete "secon" and insert --second-- therefor.

Column 6, line 7, delete "invvention" and insert --invention-- therefor.

Signed and Sealed this

*Thirtieth* Day of *March 1982*

[SEAL]

*Attest:*

GERALD J. MOSSINGHOFF

*Attesting Officer*

*Commissioner of Patents and Trademarks*